US011100842B2

(12) United States Patent
Huang

(10) Patent No.: US 11,100,842 B2
(45) Date of Patent: Aug. 24, 2021

(54) DISPLAY PANEL, AND METHOD AND DEVICE FOR DRIVING DISPLAY PANEL

(71) Applicant: HKC Corporation Limited, Guangdong (CN)

(72) Inventor: Beizhou Huang, Guangdong (CN)

(73) Assignee: HKC Corporation Limited, Shenzhen (CN)

( * ) Notice: Subject to any disclaimer, the term of this patent is extended or adjusted under 35 U.S.C. 154(b) by 249 days.

(21) Appl. No.: 16/490,551

(22) PCT Filed: Nov. 14, 2018

(86) PCT No.: PCT/CN2018/115300
§ 371 (c)(1),
(2) Date: Sep. 1, 2019

(87) PCT Pub. No.: WO2020/062475
PCT Pub. Date: Apr. 2, 2020

(65) Prior Publication Data

US 2021/0158775 A1 May 27, 2021

(30) Foreign Application Priority Data

Sep. 28, 2018 (CN) ..... 201811138564.6

(51) Int. Cl.
*G09G 3/20* (2006.01)
*G09G 3/36* (2006.01)

(52) U.S. Cl.
CPC ..... *G09G 3/2092* (2013.01); *G09G 3/36* (2013.01); *G09G 2320/0247* (2013.01); *G09G 2320/0252* (2013.01); *G09G 2320/103* (2013.01); *G09G 2340/16* (2013.01); *G09G 2360/16* (2013.01)

(58) Field of Classification Search
CPC ..... G09G 3/36–3696; G09G 2340/16; G09G 2320/103
See application file for complete search history.

(56) References Cited

U.S. PATENT DOCUMENTS

| | | | | |
|---|---|---|---|---|
| 7,696,988 | B2 * | 4/2010 | Wu | G09G 3/3648 345/204 |
| 8,228,437 | B2 * | 7/2012 | Kim | G09G 3/3648 348/620 |
| 8,648,784 | B2 * | 2/2014 | Lee | G09G 3/2092 345/94 |
| 9,640,131 | B2 * | 5/2017 | Croxford | G09G 5/395 |
| 2005/0225522 | A1 * | 10/2005 | Wu | G09G 3/3648 345/87 |
| 2008/0001872 | A1 * | 1/2008 | Abe | G09G 3/3611 345/87 |

(Continued)

FOREIGN PATENT DOCUMENTS

| | | |
|---|---|---|
| CN | 1530900 A | 9/2004 |
| CN | 1913585 A | 2/2007 |

(Continued)

*Primary Examiner* — Patrick F Marinelli

(57) ABSTRACT

Disclosed is a method for driving a display panel of obtaining image data of a current image frame and a previous image frame, and prohibiting amplification of a driving voltage on condition that an image noise exists in the current image frame. Disclosed further are a display panel and a device for controlling and driving the display panel.

14 Claims, 4 Drawing Sheets

(56) References Cited

U.S. PATENT DOCUMENTS

| | | | | |
|---|---|---|---|---|
| 2010/0079473 | A1* | 4/2010 | Choi | G09G 3/3648 345/545 |
| 2010/0157159 | A1* | 6/2010 | Kim | H04N 5/213 348/607 |
| 2010/0207960 | A1* | 8/2010 | Kimpe | G09G 3/3648 345/618 |
| 2011/0080438 | A1* | 4/2011 | Lee | G09G 5/003 345/690 |
| 2015/0228248 | A1* | 8/2015 | Croxford | G09G 3/2003 345/690 |

FOREIGN PATENT DOCUMENTS

| | | | | |
|---|---|---|---|---|
| CN | 101098420 | A | | 1/2008 |
| CN | 101266768 | A | | 9/2008 |
| CN | 101714341 | A | | 5/2010 |
| CN | 101764924 | A | | 6/2010 |
| CN | 102318001 | A | | 1/2012 |
| CN | 104835458 | A | | 8/2015 |
| CN | 105304031 | A | | 2/2016 |
| JP | 2010066384 | A | * | 3/2010 |
| JP | 2010066384 | A | | 3/2010 |

* cited by examiner

DISPLAY PANEL, AND METHOD AND DEVICE FOR DRIVING DISPLAY PANEL

TECHNICAL FIELD

This present disclosure relates to the technical field of display, and particularly, to a display panel, and a method and a device for driving the display panel.

BACKGROUND

The driving board of display receives the image signal sent by the whole system board, often with noise. However, the program for driving the display panel basically has an Over Drive (OD) function, and enabling of the OD function may amplify the original noise in the image signal, so that the display picture has flicker noise that can be distinguished by human eyes.

SUMMARY

The main objective of the present disclosure is to provide a method for driving a display panel, which aims to avoid occurrence of flicker noises and improve image display quality of the display panel.

In order to achieve the above objective, the present disclosure provides a method for driving a display panel, including the following operations:

obtaining first image data of a current image frame and second image data of a previous image frame;

determining whether a data difference exists between the first luminous characteristic value in the first image data and the second luminous characteristic value in the second image data;

if yes, determining whether an image noise exists in the first image data according to the data difference; and prohibiting amplification of the driving voltage on condition that an image noise exists in the first image data.

Further, to achieve the above object, the present disclosure further provides a device for controlling and driving a display panel including: a memory, a processor, and a program for driving a display panel stored on the memory and capable of running on the processor. On condition that the program for driving the display panel is implemented by the processor, the following operations of the method for driving the display panel are realized:

obtaining first image data of a current image frame and second image data of a previous image frame;

determining whether a data difference exists between the first luminous characteristic value in the first image data and the second luminous characteristic value in the second image data;

if yes, determining whether an image noise exists in the first image data according to the data difference; and prohibiting amplification of the driving voltage on condition that an image noise exists in the first image data.

Further, to achieve the above object, the present disclosure further provides a display panel including a device for controlling and driving a display panel. The device for controlling and driving the display panel includes: a memory, a processor, and a program for driving a display panel stored on the memory and capable of running on the processor. On condition that the program for driving the display panel is implemented by the processor, the following operations of the method for driving the display panel are realized:

obtaining first image data of a current image frame and second image data of a previous image frame;

determining whether a data difference exists between the first luminous characteristic value in the first image data and the second luminous characteristic value in the second image data;

if yes, determining whether an image noise exists in the first image data according to the data difference; and prohibiting amplification of the driving voltage on condition that an image noise exists in the first image data.

A method for driving a display panel according to an embodiment of the present disclosure is to discriminate whether an image noise exists in the first image data by the data difference and prohibit amplification of a driving voltage on condition that an image noise exists on condition that a data difference exists between a first luminous characteristic value of first image data of the current image frame and a second luminous characteristic value of second image data of the previous image frame. The amplification of the driving voltage is prohibited on condition that the first image data is converted into a video picture of a pixel unit 1 for driving the signal driving display panel, the image noise that comes with the image data would not be affected by the amplification of the overshoot voltage which results in the occurrence of the flicker noise of the display image, thereby avoiding the occurrence of the flicker noise and improving the image display quality of the display panel.

With reference to the drawings, the implement of the object, features and advantages of the present disclosure will be further illustrated in conjunction with embodiments.

DETAILED DESCRIPTION OF THE EMBODIMENTS

It should be understood that the specific embodiments described herein are only for illustrating but not for limiting the present disclosure.

On condition that the OD function is enabled, the original noise in the image signal may be amplified, so the display picture has the flicker noise that can be distinguished by the human eyes.

The present disclosure provides the following solutions to avoid the flicker noise of the display image due to the image noise comes with the image data, and improve the quality of the image displayed on the display panel.

Figure 1:
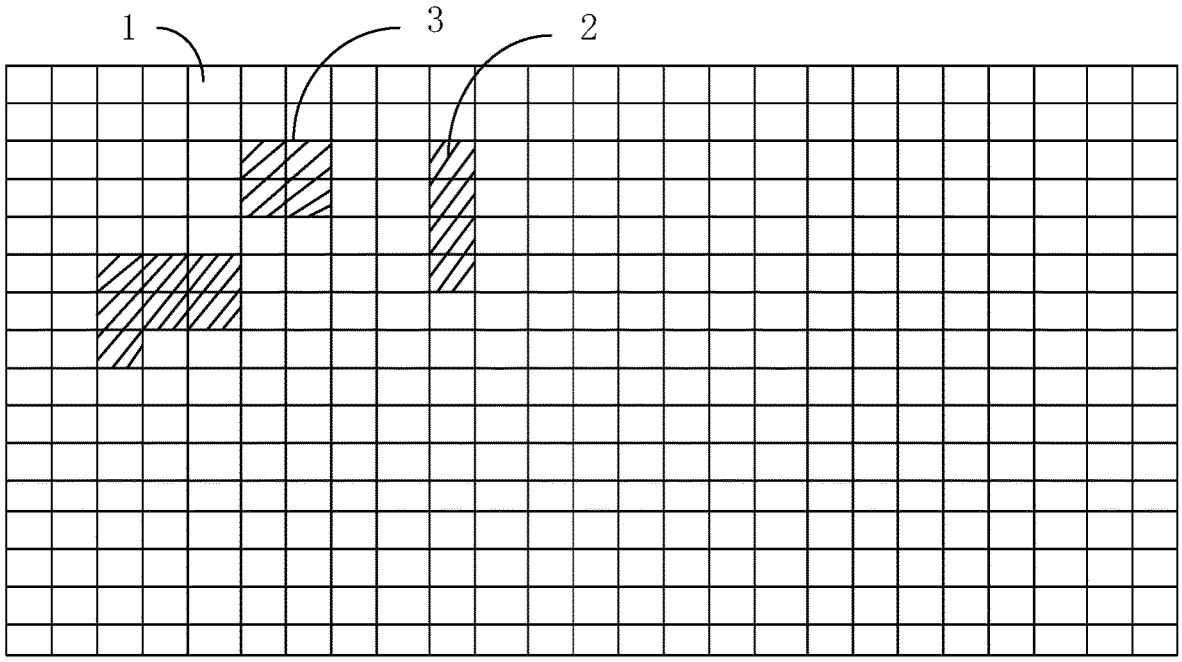
FIG. 1 is a schematic diagram of a pixel distribution on a display panel of the present disclosure.

In embodiments of the present disclosure, a display panel is provided. Specifically, the display panel is a liquid crystal display panel. As shown in FIG. 1, a plurality of pixels are provided on the display panel in the horizontal direction and the vertical direction. For example, the quantity of pixels of a display panel with a resolution of 160*128 is 160 in the horizontal direction and 128 in the vertical direction. One pixel is defined as one pixel unit 1.

On condition that the display panel display image, the system board sends the image data to the driving board, and the driving board converts the received image data into a driving signal, and sends the driving signal to the pixel unit 1 to drive the pixel unit 1 to emit light, thereby realizing image display.

In the liquid crystal display panel, during the process of driving the pixel unit 1 to emit light by the driving signal, the overdriver is enabled to provide an overshoot voltage to the pixel unit 1 to increase the driving voltage of the pixel unit 1, thereby improving the response time of the liquid crystal, which improves the speed the display panel displays images. Herein, the overdriver is a module composed of an electronic component that provides the overshoot voltage and a connection circuit thereof.

Figure 2:
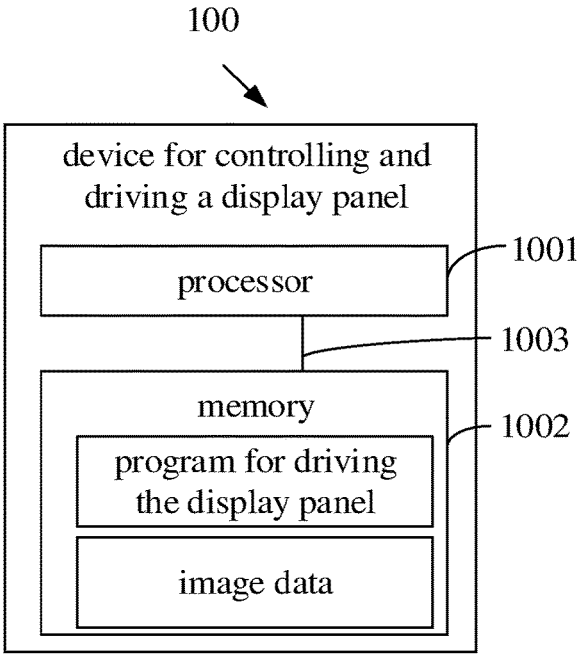
FIG. 2 is a schematic diagram of the hardware structure of a device for driving and controlling a display panel according to embodiments of the present disclosure.

Further, the display panel may further include a device for driving and controlling the display panel 100. As shown in FIG. 2, the device for driving and controlling the display panel 100 may include a processor 1001 such as a CPU, a memory 1002, and a communication bus 1003. The communication bus 1003 is configured to realize connection and communication between the assemblies. The memory 1002 can be a high-speed RAM memory, and can also be a non-volatile memory, such as a magnetic disk memory. The memory 1002, alternatively, can also be a storage device independent from the aforementioned processor 1001.

Those skilled in the art may appreciate that the device structure illustrated in FIG. 2 does not limit the computer device which may include more or fewer components as shown in figures, or have combinations of certain components or different arrangement of components.

As shown in FIG. 2, the memory 1002, as a computer storage medium, may include a program for driving the display panel and image data. The processor may be connected to a driving board, an overdriver, etc. in the display panel. The processor 1001 may be configured to call the program for driving the display panel stored on the memory 1002 and perform the operations of the method for driving the display panel in the following embodiments.

Figure 3:
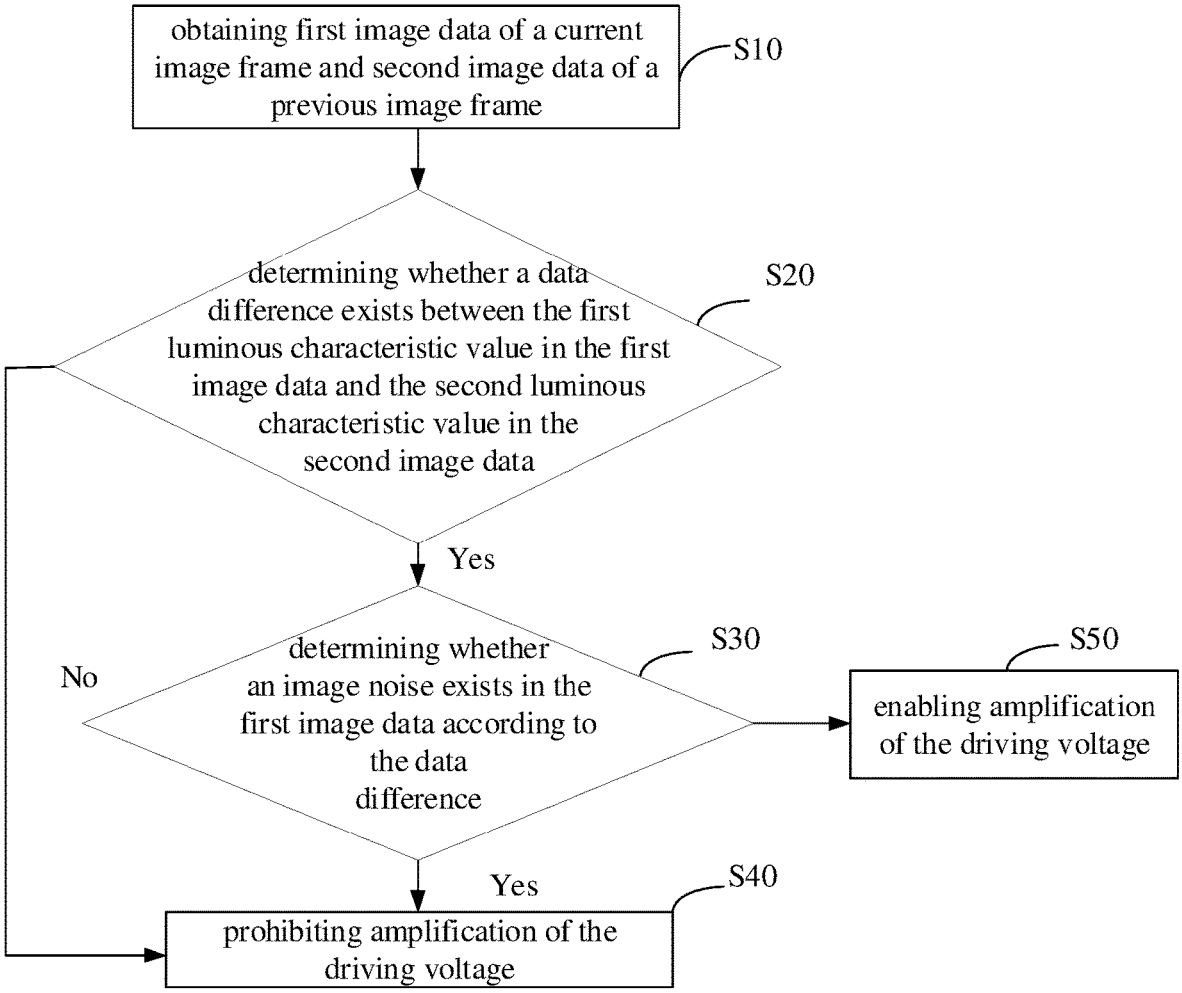
FIG. 3 is a flow chart of a method for driving a display panel according to an embodiment of the present disclosure.

Referring to FIG. 3, embodiments of the present disclosure provides a method for driving the display panel, including:

S10, obtaining first image data of a current image frame and second image data of a previous image frame;

The image data of all image frames received by the driving board from the system board may be stored on the memory as needed. Specifically, the image data stored on the memory may include second image data of a previous image frame of the current image frame received from the system board. The system board could send the first image data of the current image frame to the driving board during the process of the driving board converting the second image data of the previous image frame into a driving signal, and displaying the previous image frame by driving the pixel unit 1 of the display panel to emit light through the driving signal. The second image data of the previous image frame may be extracted from the memory after the driving board receives the first image data.

The first image data and the second image data are original image data that are required to display by the display panel, and the first image data and the second image data include the luminous characteristic value of each of the pixel units 1 on the display panel and the corresponding relation between luminous characteristic values and pixel units. The luminous characteristic value may specifically include gray scale, lightness, gradation, and the like. The luminous characteristic value of the first image data is defined as a first luminous characteristic value, and the luminous characteristic value of the second image data is defined as a second luminous characteristic value.

S20, determining whether a data difference exists between the first luminous characteristic value in the first image data and the second luminous characteristic value in the second image data;

S30 will be performed on condition that a data difference exists between the first luminous characteristic value in the first image data and the second luminous characteristic value in the second image data; step S40 will be performed on condition that no data difference exists between the first luminous characteristic value in the first image data and the second luminous characteristic value in the second image data.

The first luminous characteristic value and the second luminous characteristic value may include a luminous characteristic value of a single pixel unit 1 in the image data, or a total luminous characteristic value of the image frame in the entire display panel, or a luminous characteristic value of the standard pixel block, etc. or would be calculated according to the luminous characteristic value of each pixel unit 1 in the image data. Correspondingly, the data difference herein may include a difference between the first luminous characteristic value and the second luminous characteristic value of the single pixel unit 1 in the first image data and the second image data, or a difference between the current image frame and the previous image frame in the total luminous characteristic value of the entire display panel, or a difference of the luminous characteristic value of the standard pixel block in the first image data and the second image data. The luminous characteristic value of the pixel unit 1 at the same position on the display panel would be extracted from the first image data and the second image data respectively, the first luminous characteristic value and the second luminous characteristic value of the pixel unit 1 at the same position on the display panel would be compared one by one. Whether a data difference exists between first image data and second image data would be determined based on the comparison result. Specifically, it is determined that no data difference exists between the first image data and the second image data if the first luminous characteristic value and the second luminous characteristic value of all the pixel units 1 located at the same position on the display panel in the first image data and the second image data are consistent; it is determined that a data difference exists between the first luminous characteristic value of the first image data and the second luminous characteristic value of the second image data if the first luminous characteristic value and the second luminous characteristic value of all the pixel units 1 located at the same position on the display panel in the first image data and the second image data are partially or wholly inconsistent.

In addition, the pixel unit 1 of the display panel may also be divided into a plurality of standard pixel blocks, and one standard pixel block includes a plurality of successive pixel units 1. luminous characteristic values of the standard pixel blocks at the same position on the display panel would be extracted from the first image data and the second image data, and compared one by one and it would be determined whether a data difference exists between the first luminous characteristic value in the first image data and the second luminous characteristic value in the second image data based on the comparison result. The luminous characteristic value of the standard pixel block may be calculated according to the luminous characteristic value of the pixel unit 1 in the standard pixel block. The manner in which the data difference between the first image data and the second image data is determined by the standard pixel block may be similar to that of the above-mentioned determination by the single pixel unit 1, and details are not described herein.

Step S30, determining whether an image noise exists in the first image data according to the data difference;

perform step S40 if the image noise exists in the first image data; perform step S50 if no image noise exists in the first image data.

The pixel unit 1 in which the data difference exists is defined as a differential pixel unit 2. It may be directly determined whether an image noise exists by the data difference value between the first luminous characteristic value and the second luminous characteristic value of the differential pixel unit 2 on condition that the quantity of the differential pixel unit 2 is one. It is determined that an image noise exists in the first image data on condition that the data difference is less than or equal to the first preset value, and determined that no image noise exists in the first image data on condition that the data difference is greater than the first preset value; the position of the differential pixel unit 2 on the display panel, and the distance between the position of the differential pixel unit 2 on the display panel and the edge of the display panel may also be determined on condition that the data difference value is greater than the first preset value. It is determined that no image noise exists in the first image data on condition that the distance is less than or equal to a preset distance, and it is determined that an image noise exists in the first image data on condition that the distance is greater than a preset distance. Since the differential pixel unit 2 is a small display area corresponding to a single display panel which is not easily perceived by naked eyes, the closer the distance from the edge is, the lower the influence on the display picture is. Therefore, the picture display quality of the display panel would also be ensured in the above manner, according to whether an image noise exists in the first image data would be determined according to the data difference value of the difference pixel unit 2 or not and the above-mentioned distance.

Figure 4:
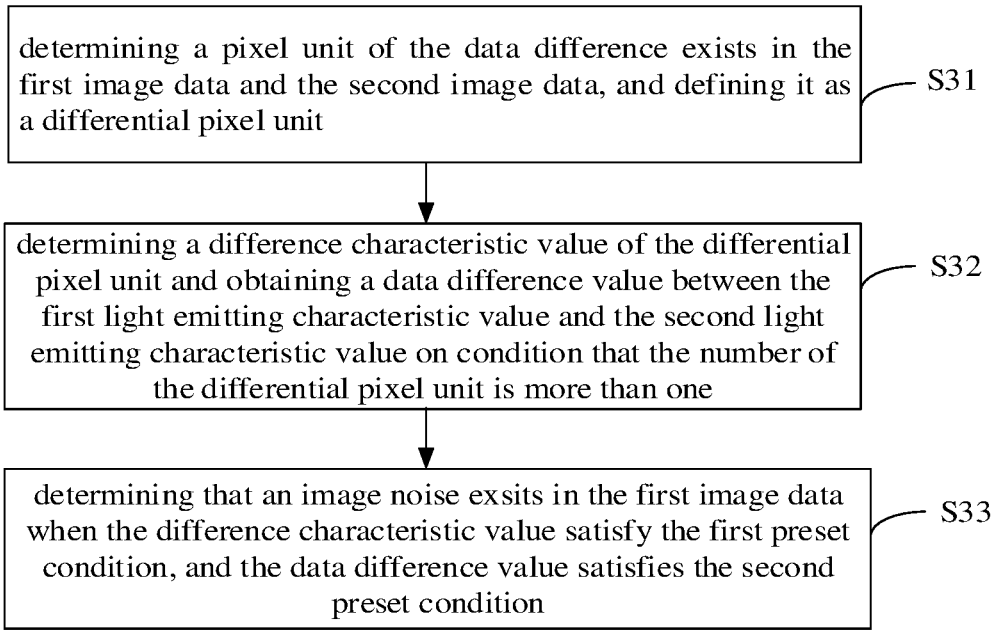
FIG. 4 is a flow chart of a method for driving a display panel of another embodiment of the present disclosure.

On condition that the quantity of the differential pixel unit 2 is more than one, referring to FIG. 4, the operations of determining whether an image noise exists in the first image data according to the data difference include:

step S31, determining a pixel unit 1 of the data difference exists in the first image data and the second image data, and defining it as a differential pixel unit 2;

the determined differential pixel unit 2 is a pixel unit 1 in which a data difference exists in the first image data and the second image data on condition that the data difference is the difference between the first luminous characteristic value and the second luminous characteristic value of the single pixel unit 1. The determined differential pixel unit 2 is a pixel unit 1 in which a data difference exists in the first image data and the second image data of the standard pixel block on condition that the data difference is the luminous characteristic value between the standard pixel block of the first image data and the second image data.

Step S32, determining a difference characteristic value of the differential pixel unit 2 and obtaining a data difference value between the first luminous characteristic value and the second luminous characteristic value on condition that the quantity of the differential pixel unit 2 is more than one;

the quantity of the differential pixel units 2 may be counted in the process of comparing the first image data and the second image data. The difference characteristic value of the differential pixel unit 2 may be counted on condition that the quantity of the differential pixel units 2 is plural. The difference characteristic value may include a position of the differential pixel unit 2 on the display panel, the quantity of the differential pixel unit 2, a corresponding difference area of the differential pixel unit 2 on the display panel, etc.

The data difference value between the first image data and the second image data may be a difference value of the luminous characteristic value of the single pixel unit 1; may also be a difference value between the luminous characteristic values of the standard pixel blocks in the first image data and the second image data; may also be a total difference value calculated based on a weighted average of using a difference value between luminous characteristic values of all differential pixel units 2 in the first image data and the second image data and the preset proportion. The preset proportion may be allocated according to the minimum distance of the difference pixel unit 2 on the display panel from the edge of the display panel. The longer the minimum distance of the difference pixel unit 2 from the edge of the display panel, the greater the proportion will be. The shorter the minimum distance of the difference pixel unit 2 from the edge of the display panel, the smaller the proportion will be.

Step S33, determining that an image noise exists in the first image data on condition that the difference characteristic value satisfies the first preset condition, and the data difference value satisfies the second preset condition.

The first preset condition may establish different conditions according to different difference characteristic values, different judgment criteria, etc. The specific condition that the difference characteristic value would satisfy the first preset condition may include: the minimum distance of the differential pixel unit 2 from the edge of the display panel is greater than or equal to a preset distance; and/or, the quantity of differential pixel units 2 or the quantity of pixel units 1 in the differential pixel block 3 is less than or equal to a preset quantity; the corresponding total difference area of the differential pixel unit 2 on the display panel or the difference area of the differential pixel blocks corresponding to each other is less than or equal to the preset area, etc. It may be determined that the difference characteristic value satisfies the first preset condition on condition that the above conditions are satisfied.

The second preset condition may establish different conditions according to different types of data differences, different judgment criteria, etc. The specific condition to determine that the data difference value satisfies the second preset condition may include: the difference value of the luminous characteristic value of each differential pixel unit 2 is less than or equal to a preset threshold, and/or, the difference value between the luminous characteristic values of each standard pixel block is less than or equal to a preset threshold, and/or, the total difference value of all the differential pixel units 2 is less than or equal to a preset threshold, and/or, the difference value between the luminous characteristic values of a plurality of differential pixel units 2 that is greater than or equal to the preset quantity of the differential pixel units 2 is less than or equal to a preset threshold, etc. It may be determined that the data difference value satisfies the second preset condition on condition that the above conditions are satisfied. The first preset condition and the second preset condition are both premise of the image noise determination. It is determined that the first image data has an image noise only on condition that the first preset condition and the second preset condition are simultaneously satisfied.

Step S34, determining that no image noise exists in the first image data and executing Step S50 below on condition that the difference characteristic value does not satisfy the first preset condition, and/or the data difference value does not satisfy the second preset condition.

Step S40, prohibiting amplification of the driving voltage;

The image displayed by the display panel may be regarded as a static image at the point on condition that the first luminous characteristic value in the first image data and the second luminous characteristic value in the second image data are consistent. There is no need to change the image of the current frame and that of the previous frame, and so is the luminous state of the pixel unit 1. At this time, by prohibiting the amplification of the driving voltage of the pixel unit by turning off the overdriver, etc., it is possible to prevent the instability of the luminous state of the pixel unit 1 caused by the action of the overshoot voltage, and adversely affect the quality of the display picture. If it is determined that an image noise exists in the first image data, the overdriver is turned off to avoid the amplification of the original image noise caused by the action of the overshoot voltage which causes the occurrence of the flicker noise on the display picture.

Step S50, enabling amplification of the driving voltage.

If the data difference exists but no image noise exists in the first image data, the data difference may be considered to be caused by the image displayed by the display panel being dynamic. At this time, the overdriver can be turned on to provide an overshoot voltage to increase the driving voltage of the pixel unit and increase the speed of the picture display. The overdriver is turned on condition that the difference characteristic value does not satisfy the first preset condition, and/or the data difference value does not satisfy the second preset condition.

A method for driving a display panel according to an embodiment of the present disclosure is to discriminate whether an image noise exists in the first image data by the data difference and prohibit amplification of a driving voltage on condition that an image noise exists on condition that a data difference exists between a first luminous characteristic value of first image data of the current image frame and a second luminous characteristic value of second image data of the previous image frame. The amplification of the driving voltage is prohibited so that on condition that the first image data is converted into a video picture of a pixel unit 1 for driving the signal driving display panel, the image noise that comes with the image data would not be affected by the amplification of the overshoot voltage which results in the occurrence of the flicker noise of the display image, avoiding the occurrence of the flicker noise and improving the image display quality of the display panel.

Wherein since the image noise that comes with the image data is generally spurious and the difference between the two frames of image data is small, on condition that the quantity of the different pixel units 2 is more than one, determining whether an image noise exists in the first image data combined with the differential pixel unit 2 and the data difference value, which is advantageous for the determination result of the image noise to be more accurate, thereby further avoiding the occurrence of the flicker noise in the display image and improving the image display quality of the display panel.

Figure 5:
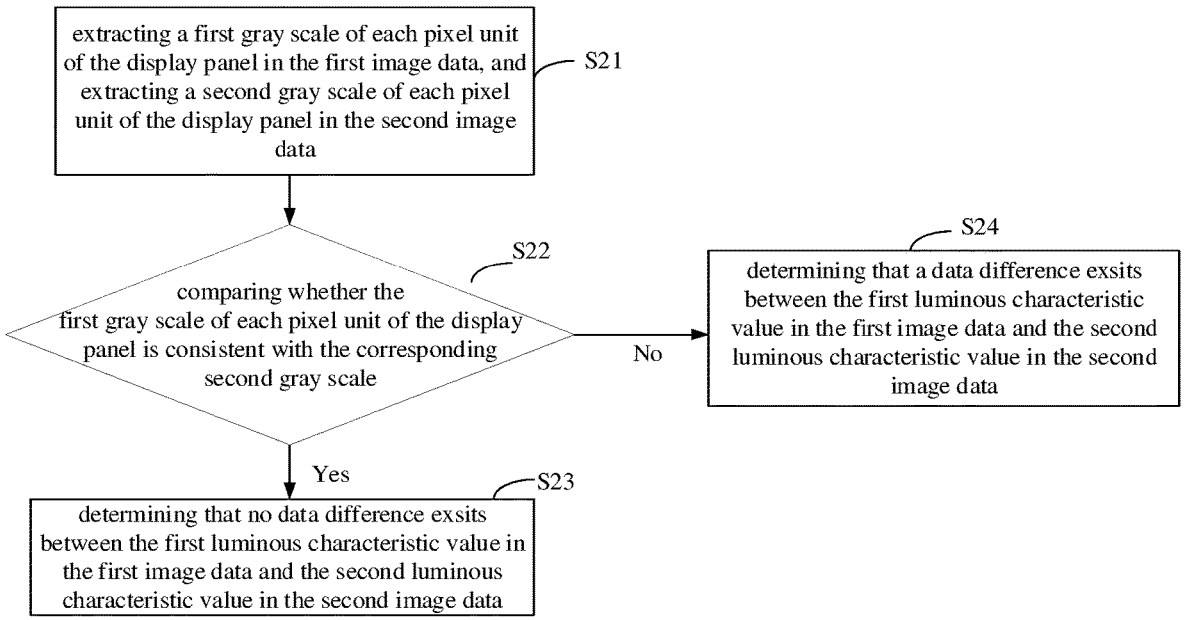
FIG. 5 is a flow chart of a method for driving a display panel of a further embodiment of the present disclosure.

Specifically, referring to FIG. 5, the data difference includes a gray scale difference, and the operations of determining whether a data difference exists between the first luminous characteristic value in the first image data and the second luminous characteristic value in the second image data include:

step S21, extracting a first gray scale of each pixel unit 1 of the display panel in the first image data, and extracting a second gray scale of each pixel unit 1 of the display panel in the second image data;

and sequentially extracting a first gray scale of each pixel unit 1 of the display panel in the first image data, and extracting, in the second image data, a second gray scale of the same pixel unit 1 as the pixel unit 1.

Step S22, comparing whether the first gray scale of each pixel unit 1 of the display panel is consistent with the corresponding second gray scale; if it is consistent, perform step S23 and if it is not, perform step S24;

step S23, determining that no data difference exists between the first luminous characteristic value in the first image data and the second luminous characteristic value in the second image data;

step S24, determining that a data difference exists between the first luminous characteristic value in the first image data and the second luminous characteristic value in the second image data.

By comparing the first gray scale and the second gray scale of the same pixel unit 1 in the first image data and the second image data one by one, if they are consistent, no data difference exists between the first luminous characteristic value in the first image data and the second luminous characteristic value in the second image data, indicating that the display panel displays a static image; if the gray scales of the partial pixel units 1 are inconsistent or the gray scales of all the pixel units 1 are inconsistent, a data difference exists between the first luminous characteristic value in the first image data and the second luminous characteristic value in the second image data, indicating that the display panel displays a dynamic image or an image noise exists in the first image data. In addition, the data difference can also be determined by comparing the comparison results by standard pixel blocks.

In the present embodiment, since the gray scale determines the color change on condition that the pixel unit 1 emits light, the gray scales of each pixel unit 1 on the display panel in the first image data and the second image data are compared one by one to determine whether a data difference exists between the first luminous characteristic value in the first image data and the second luminous characteristic value in the second image data, so that an accurate determination result can be obtained intuitively.

Further, the data difference value includes a gray scale difference value, and the operations of obtaining a data difference value between the first luminous characteristic value in the first image data and the second luminous characteristic value in the second image data include:

step S321, obtaining a gray scale difference value between a first gray scale and a second gray scale of each of the differential pixel units 2;

in the process of comparing the first gray scale and the second gray scale of each pixel unit 1, the gray scale difference value between the first gray scale and the second gray scale may be calculated. If the gray scale difference value is greater than 0, a data difference exists between the first image data and the second image data, and the gray scale difference value is stored. If the gray scale difference value is 0, no data difference exists between the first image data and the second image data. When the image noise of the first image data is judged, the gray scale difference value of each of the different pixel units 2 may be obtained.

The operations after obtaining a data difference value between the first luminous characteristic value and the second luminous characteristic value further include:

step S01, determining whether a gray scale difference value of each of the differential pixel units 2 is less than or equal to a preset threshold; if yes, proceed to step S02, and if not, perform step S03.

Step S02, determining that the data difference value satisfies the second preset condition; and step S03, determining that the data difference value does not satisfy the second preset condition.

In the above manner, it is ensured that the gray scale difference value of each of the different pixel units 2 is less than or equal to a preset threshold, after which it is determined that the data difference value satisfies the second preset condition, thereby ensuring that the presence of the image noise of the pixel unit 1 of the first image data at an arbitrary position may be identified, improving the reliability of image noise recognition.

Further, as shown in FIG. 1, a successive differential pixel unit 2 is defined to form a differential pixel block 3; the difference characteristic value includes the quantity of differential pixel units 2 in the differential pixel block 3 or a difference area corresponding to the differential pixel block 3, etc., which can be selected according to actual needs.

The operations of determining a difference characteristic value of the differential pixel unit 2 include:

step S322, determining whether the differential pixel unit 3 exists in the differential pixel unit 2;

perform step S3221, step S04 if difference pixel module exists, on condition that the difference characteristic value includes the quantity of the differential pixel unit 2 in the differential pixel block 3 and perform step S3231, step S05 on condition that the difference characteristic value includes the difference area corresponding to the differential pixel block 3; and perform the above step S321 if no difference pixel module exists; if no differential pixel block 3 exists in the differential pixel unit 2, it indicates that the differential pixel unit 2 has a scattered distribution on the display panel. At this time, it may be determined whether an image noise exists in the first image data according to the gray scale difference value.

Step S3221, determining the quantity of differential pixel units 2 in the differential pixel unit 3;

step S3231, determining the quantity of differential pixel units 2 in the differential pixel unit 3;

step S3232, calculating, according to determining the quantity of differential pixel units 2 in the differential pixel unit 3 and a preset unit area, a difference area corresponding to the differential pixel block 3;

Herein, the quantity of differential pixel units 2 in the differential pixel block 3 is the total quantity constituting the differential pixel block 3 in all the differential pixel units 2. The preset unit area is the area in which each pixel unit 1 displaying images on the display panel. The difference area corresponding to the differential pixel block 3 can be obtained by multiplying the quantity of the differential pixel units 2 in the differential pixel block 3 by the preset unit area.

The operations after determining a difference characteristic value of the differential pixel unit 2 further include:

step S04, determining whether the quantity of the differential pixel units 2 in the differential pixel block 3 is less than or equal to a preset quantity; if it is less than or equal to the preset one, perform step S06, and if it is greater than the preset one, perform step S07. The presets herein can be specifically set according to the characteristics of different display panels. Wherein, determining whether the quantity of the differential pixel units 2 in the differential pixel block 3 is less than or equal to a preset quantity on condition that there are multiple differential pixel blocks 3; if yes, perform step S06, and if it is partially or wholly greater than the preset one, perform step S07.

Step S05, determining whether the difference area is less than or equal to a preset area; if it is less than or equal to the preset one, perform step S06, and if it is greater than the preset one, perform step S07. The preset area herein can be specifically set according to the characteristics of different display panels. Wherein determining whether the difference area corresponding to the differential pixel block 3 is less than or equal to a preset difference area on condition that there are multiple differential pixel blocks 3. If yes, perform step S06, and if it is partially or wholly greater than the preset one, perform step S07.

Step S06, determining that the difference characteristic value satisfies the first preset condition;

Step S07, determining that the difference characteristic value does not satisfy the first preset condition.

The distribution of the pixel units 1 with data differences caused by the dynamic images is generally concentrated and wide-spread, with a plurality of cluster-type distributions on the display panel. The pixel units 1 with data differences due to image noise are generally relatively scattered and small in area. Therefore, it is possible to determine whether an image noise exists in the first image data by the size of the differential pixel block 3 if a differential pixel block 3 exists in the differential pixel unit 2 of the first image data and the second image data. Wherein, on condition that the quantity of the differential pixel units 2 in the differential pixel block 3 is greater than the preset quantity or the difference area corresponding to the differential pixel block 3 is greater than the preset area, it indicates that no image noise exists in the first image data, and the data difference is caused by the display image being the dynamic image; on condition that the quantity of the differential pixel units 2 in the differential pixel block 3 is less than or equal to the preset quantity or difference area corresponding to the preset or the difference area corresponding to the differential pixel block 3 is less than or equal to the preset area, it indicates that an image noise exists in the first image data.

The quantity of differential pixel units 2 in the differential pixel block 3 or the difference area corresponding to the differential pixel block 3 is used as the difference characteristic value of the differential pixel unit 2, which is advantageous for further ensuring accurate recognition of image noise.

In addition, the embodiment of the present disclosure further provides a device for driving and controlling a display panel. The device for driving and controlling the display panel includes an image data acquisition module, a first determining module, a second determining module, and a driving module. The image data acquisition module is configured to obtain first image data of a current image frame and second image data of a previous image frame; the first determining module is configured to determine whether a data difference exists between the first luminous characteristic value of the first image data and the second luminous characteristic value of the second image data; the second determining module is configured to determine, if the data difference exists, whether an image noise of the first image data exists; the driving module is configured to prohibit amplification of the driving voltage on condition that the image noise exists in the first image data.

Specifically, the second determining module is configured to determine a pixel unit of the data difference exists in the first image quantity and the second image data, and is defined as a differential pixel unit; on condition that the quantity of the differential pixel units is more than one, determining a difference characteristic value of the differential pixel unit, and obtaining a data difference value between the first luminous characteristic value and the second luminous characteristic value; and determining that an image noise exists in the first image data on condition that the difference characteristic value satisfies a first preset condition and the data difference value satisfies a second preset condition.

Wherein the data difference includes a gray scale difference, and the first determining module is configured to extract a first gray scale of each pixel unit of the display panel in the first image data, and extract a second gray scale of each pixel unit of the display panel in the second image data; comparing whether the first gray scale of each pixel unit of the display panel is consistent with the corresponding second gray scale thereof; if yes, it is determined that no data difference exists between the first luminous characteristic value in the first image data and the second luminous characteristic value in the second image; and, if not, it is determined that a data difference exists between the first luminous characteristic value in the first image data and the second luminous characteristic value in the second image data.

Specifically, the data difference value includes a gray scale difference value, and the second determining module is specifically configured as performing the operation of obtaining a data difference value between the first luminous characteristic value in the first image data and the second luminous characteristic value in the second image data, including: obtaining a gray scale difference value between a first gray scale and a second gray scale of each of the differential pixel units; the operations after obtaining a data difference between the first luminous characteristic value and the second luminous characteristic value further includes: determining whether a gray scale difference value of each of the differential pixel units is less than or equal to a preset threshold; if yes, determining that the data difference value satisfies the second preset condition; f no, determining that the data difference value does not satisfy the second preset condition.

Determining the quantity of differential pixel units in the a successive differential pixel unit is defined to form a differential pixel block; the difference characteristic value includes the quantity of differential pixel units in the differential pixel block or a difference area corresponding to the differential pixel block; the operations of determining a difference characteristic value of the differential pixel unit by the second determining module includes: determining whether the differential pixel unit exists in the differential pixel unit; determining the quantity of differential pixel units in the differential pixel block on condition that the difference characteristic value includes the quantity of differential pixel units in the differential pixel block; and/or determining the quantity of differential pixel units in the differential pixel block on condition that the difference characteristic value includes a difference area corresponding to the difference pixel block and calculating, according to the quantity of differential pixel units in the differential pixel block and a preset unit area, a difference area corresponding to the differential pixel block;

the operations after determining a difference characteristic value of the differential pixel unit performed by the second determining module further includes: determining whether the quantity of differential pixel units in the differential pixel block is less than or equal to a preset quantity on condition that the difference characteristic value includes the quantity of differential pixel units in the differential pixel block; and determining whether the difference area is less than or equal to a preset area on condition that the difference characteristic value includes a difference area corresponding to the difference pixel block; if yes, it is determined that the difference characteristic value satisfies the first preset condition; and if not, it is determined that the difference characteristic value does not satisfy the first preset condition.

Further, a driving module, configured to enable amplification of the driving voltage on condition that the difference characteristic value does not satisfy the first preset condition, and/or the data difference value does not satisfy the second preset condition; and/or the operation of prohibiting amplification of the driving voltage is performed on condition that no data difference exists between the first luminous characteristic value in the first image data and the second luminous characteristic value in the second image data.

In addition, the embodiment of the present disclosure further provides a readable storage medium, where the readable storage medium stores a program for driving the display panel. When the program for driving the display panel is implemented by the processor, the following operations of the method for driving the display panel are realized: obtaining first image data of a current image frame and second image data of a previous image frame; determining whether a data difference exists between the first luminous characteristic value of the first image data and the second luminous characteristic value of the second image data; determining, if the data difference exists, whether an image noise of the first image data exists; prohibiting amplification of the driving voltage on condition that the image noise exists in the first image data.

The implementations of the readable storage medium of the present disclosure is substantially the same as the embodiment of the method for driving the display panel described above, and details are not described herein again.

It should be noted that terms "comprising", "including" or any other variants herein are intended to cover the non-exclusive including, thereby making that the process, method, merchandise or system comprising a series of elements comprise not only those elements but also other elements that are not listed explicitly or the inherent elements to the process, method, merchandise or system. In the case of no more limitations, the element limited by the sentence "comprising a . . . " does not exclude that there exists another same element in the process, method, merchandise or system comprising the element.

The serial numbers of the embodiments of the present disclosure are merely for the description, and do not represent the advantages and disadvantages of the embodiments.

Through the description of the above implementations, those skilled in the art can clearly understand that the foregoing embodiment method can be implemented by means of software plus a necessary general hardware platform, and of course, can also be implemented through hardware, but in many cases, the former is better. Based on the understanding, the technical schemes of the present disclosure in essence illustrate the part contributing to the prior art or the part of the technical schemes in the form of a software product, the computer software product is stored on a storage medium (such as ROM/RAM, disk, CD), including some instructions for making a terminal device (mobile phone, computer, server, air-conditioner or network device and the like) implement the methods in the embodiments of the present disclosure.

The above is only the alternative embodiment of the present disclosure, which does not limit the patent scope of the present disclosure, and any equivalent structure or process made by using the specification and the drawings of the present disclosure or direct or indirect applications in other related technical fields should be contained in the scope of patent protection in a similar way.

What is claimed is:

1. A method for driving a display panel, comprising:

obtaining first image data of a current image frame and second image data of a previous image frame;

determining whether a data difference exists between a first luminous characteristic value in the first image data and a second luminous characteristic value in the second image data;

when a data difference exists, determining whether an image noise exists in the first image data according to the data difference; and when an image noise exists, prohibiting an amplification of a driving voltage on the condition that no data difference exists between the first luminous characteristic value in the first image data and the second luminous characteristic value in the second image data, wherein the operations of determining whether the image noise exists in the first image data according to the data difference comprise:

determining a pixel unit of the data difference exists in the first image data and the second image data, and defining it as a differential pixel unit;

obtaining a data difference value between the first luminous characteristic value and the second luminous characteristic value on the condition that the quantity of the differential pixel unit is one; and determining that the image noise exists in the first image data on the condition that the data difference value is less than or equal to the first preset value, wherein the operations of determining whether the image noise exists in the first image data according to the data difference further comprise:

determining a position of the differential pixel unit on the display panel on the condition that the data difference value is greater than a first preset value;

determining a distance between the position and an edge of the display panel; and determining that the image noise exists in the first image data on the condition that the distance is greater than a first preset distance.

2. The method for driving the display panel according to claim 1, wherein defining a standard pixel block comprises a plurality of successive pixel units, the first luminous characteristic value is a luminous characteristic value of the standard pixel block in the first image data and the second luminous characteristic value is a luminous characteristic value of the standard pixel block in the second image data, the operations of determining whether the data difference exists between the first luminous characteristic value in the first image data and the second luminous characteristic value in the second image data comprise:

extracting, from the first image data and the second image data, luminous characteristic values of the standard pixel blocks at the same position on the display panel and comparing the luminous characteristic values one by one; and determining whether the data difference exists between the first luminous characteristic value in the first image data and the second luminous characteristic value in the second image data based on the comparison result.

3. A method for driving a display panel, comprising:

obtaining first image data of a current image frame and second image data of a previous image frame;

determining whether a data difference exists between a first luminous characteristic value in the first image data and a second luminous characteristic value in the second image data;

when a data difference exists, determining whether an image noise exists in the first image data according to the data difference; and when an image noise exists, prohibiting an amplification of a driving voltage on the condition that no data difference exists between the first luminous characteristic value in the first image data and the second luminous characteristic value in the second image data, wherein the operations of determining whether an image noise exists in the first image data according to the data difference comprise:

determining a pixel unit of the data difference exists in the first image data and the second image data, and defining it as a differential pixel unit;

determining a difference characteristic value of a differential pixel unit and obtaining a data difference value between the first luminous characteristic value and the second luminous characteristic value on the condition that the quantity of a differential pixel units is more than one; and determining that the image noise exists in the first image data on the condition that the difference characteristic value satisfies a first preset condition, and the data difference value satisfies a second preset condition, wherein determining that the difference characteristic value satisfies the first preset condition on the condition that a minimum distance of a differential pixel unit from an edge of the display panel is greater than or equal to a preset distance, and/or on the condition that the quantity of a differential pixel units is less than or equal to a preset quantity, and/or on the condition that a total difference area of a differential pixel units on the display panel is less than or equal to a preset area.

4. The method for driving the display panel according to claim 3, wherein determining that the data difference value satisfies the second preset condition on the condition that the data difference value of the luminous characteristic values of each of the differential pixel units is less than or equal to a preset threshold, and/or on the condition that a difference value of the luminous characteristic values of each of the standard pixel block is less than or equal to a preset threshold, and/or, on the condition that a total difference value of luminous characteristic values of all differential pixel units is less than or equal to a preset threshold.

5. The method for driving the display panel according to claim 3, wherein the method further comprises the following operation:

enabling the amplification of the driving voltage on the condition that the difference characteristic value does not satisfy the first preset condition, and/or the data difference value does not satisfy the second preset condition.

6. The method for driving the display panel according to claim 3, wherein the data difference comprises a gray scale difference, and the operations of determining whether the data difference exists between the first luminous characteristic value in the first image data and the second luminous characteristic value in the second image data comprise:

extracting a first gray scale of each pixel unit of the display panel in the first image data, and extracting a second gray scale of each pixel unit of the display panel in the second image data;

comparing the first gray scale of each pixel unit of the display panel with the corresponding second gray scale, for determining whether the first gray scale of each pixel unit is consistent with the corresponding second gray scale;

if yes, determining that no data difference exists between the first luminous characteristic value in the first image data and the second luminous characteristic value in the second image data; and if no, determining that a data difference exists between the first luminous characteristic value in the first image data and the second luminous characteristic value in the second image data.

7. The method for driving the display panel according to claim 6, wherein the data difference value comprises a gray scale difference value, and the operation of obtaining the data difference value between the first luminous characteristic value in the first image data and the second luminous characteristic value in the second image data comprises:

obtaining a gray scale difference value between a first gray scale and a second gray scale of each of the differential pixel units;

after the operations of obtaining the data difference value between the first luminous characteristic value and the second luminous characteristic value, the method further comprise:

determining whether the gray scale difference value of each of the differential pixel units is less than or equal to a preset threshold;

if yes, determining that the data difference value satisfies the second preset condition; and if no, determining that the data difference value does not satisfy the second preset condition.

8. The method for driving the display panel according to claim 7, wherein a successive differential pixel units is defined to form a differential pixel block;

the difference characteristic value includes the quantity of differential pixel units in the differential pixel block or a difference area corresponding to the differential pixel block;

the operations of determining the difference characteristic value of a differential pixel unit comprise:

determining whether the differential pixel block exists in the differential pixel unit;

determining the quantity of differential pixel units in the differential pixel block on the condition that the difference characteristic value includes the quantity of differential pixel units in the differential pixel block;

and/or determining the quantity of differential pixel units in the differential pixel block on the condition that the difference characteristic value includes the difference area corresponding to the difference pixel block, and calculating, according to the quantity of differential pixel units in the differential pixel block and a preset unit area, the difference area corresponding to the differential pixel block; after the operations of determining a difference characteristic value of the differential pixel unit, the method further comprise: determining whether the quantity of differential pixel units in the differential pixel block is less than or equal to a preset quantity on the condition that the difference characteristic value includes the quantity of differential pixel units in the differential pixel block; and determining whether the difference area is less than or equal to a preset area on the condition that the difference characteristic value includes the difference area corresponding to the difference pixel block; if yes, determining that the difference characteristic value satisfies the first preset condition; and if no, determining that the difference characteristic value does not satisfy the first preset condition.

9. A device for controlling and driving a display panel, wherein the device comprises: a memory, a processor, and a program, for driving the display panel, stored on the memory and executable on the processor to perform the following operations of a method for driving the display panel:

obtaining first image data of a current image frame and second image data of a previous image frame;

determining whether a data difference exists between the first luminous characteristic value in the first image data and the second luminous characteristic value in the second image data;

determining whether an image noise exists in the first image data according to the data difference when the data difference exists; and prohibiting amplification of the driving voltage on the condition that an image noise exists in the first image data, wherein the operations of determining whether an image noise exists in the first image data according to the data difference comprise:

determining a pixel unit of the data difference exists in the first image data and the second image data, and defining it as a differential pixel unit;

determining a difference characteristic value of the differential pixel unit and obtaining a data difference value between the first luminous characteristic value and the second luminous characteristic value on the condition that the quantity of the differential pixel units is more than one; and determining that an image noise exists in the first image data on the condition that the difference characteristic value satisfies the first preset condition, and the data difference value satisfies a second preset condition, wherein determining that the difference characteristic value satisfies the first preset condition on the condition that a minimum distance of a differential pixel unit from an edge of the display panel is greater than or equal to a preset distance, and/or on the condition that the quantity of a differential pixel units is less than or equal to a preset quantity, and/or on the condition that a total difference area of a differential pixel units on the display panel is less than or equal to a preset area.

10. The device for controlling and driving the display panel according to claim 9, wherein the data difference comprises a gray scale difference, and the operations of determining whether a data difference exists between the first luminous characteristic value in the first image data and the second luminous characteristic value in the second image data comprise:

extracting a first gray scale of each pixel unit of the display panel in the first image data, and extracting a second gray scale of each pixel unit of the display panel in the second image data;

comparing whether the first gray scale of each pixel unit of the display panel is consistent with the corresponding second gray scale;

if yes, determining that no data difference exists between the first luminous characteristic value in the first image data and the second luminous characteristic value in the second image data; and if no, determining that a data difference exists between the first luminous characteristic value in the first image data and the second luminous characteristic value in the second image data.

11. The device for controlling and driving the display panel according to claim 10, wherein a successive differential pixel unit is defined to form a differential pixel block;

the difference characteristic value includes the quantity of differential pixel units in the differential pixel block or a difference area corresponding to the differential pixel block;

the operations of determining a difference characteristic value of the differential pixel unit comprise:

determining whether the differential pixel block exists in the differential pixel unit;

determining the quantity of differential pixel units in the differential pixel block on the condition that the difference characteristic value includes the quantity of differential pixel units in the differential pixel block;

and/or determining the quantity of differential pixel units in the differential pixel block on the condition that the difference characteristic value includes a difference area corresponding to the difference pixel block and calculating, according to the quantity of differential pixel units in the differential pixel block and a preset unit area, a difference area corresponding to the differential pixel block;

the operations after determining a difference characteristic value of the differential pixel unit further comprise:

determining whether the quantity of differential pixel units in the differential pixel block is less than or equal to a preset quantity on the condition that the difference characteristic value includes the quantity of differential pixel units in the differential pixel block; and determining whether the difference area is less than or equal to a preset area on the condition that the difference characteristic value includes a difference area corresponding to the difference pixel block;

if yes, determining that the difference characteristic value satisfies the first preset condition; and if no, determining that the difference characteristic value does not satisfy the first preset condition.

12. A display panel comprising of a display panel driving control device that comprises: a memory, a processor, and a program, stored on the memory, that is executed on the processor, for performing the following operations:

obtaining first image data of a current image frame and second image data of a previous image frame;

determining whether a data difference exists between the first luminous characteristic value in the first image data and the second luminous characteristic value in the second image data;

determining whether an image noise exists in the first image data according to the data difference if the data difference exists; and prohibiting amplification of the driving voltage on condition that an image noise exists in the first image data, wherein the operations of determining whether an image noise exists in the first image data according to the data difference comprise:

determining a pixel unit of the data difference exists in the first image data and the second image data, and defining it as a differential pixel unit;

determining a difference characteristic value of the differential pixel unit and obtaining a data difference value between the first luminous characteristic value and the second luminous characteristic value on the condition that the quantity of the differential pixel units is more than one; and determining that an image noise exists in the first image data on the condition that the difference characteristic value satisfies the first preset condition, and the data difference value satisfies a second preset condition, wherein determining that the difference characteristic value satisfies the first preset condition on the condition that a minimum distance of a differential pixel unit from an edge of the display panel is greater than or equal to a preset distance, and/or on the condition that the quantity of a differential pixel units is less than or equal to a preset quantity, and/or on the condition that a total difference area of a differential pixel units on the display panel is less than or equal to a preset area.

13. The display panel according to claim 12, wherein the data difference comprises a gray scale difference, and the operations of determining whether a data difference exists between the first luminous characteristic value in the first image data and the second luminous characteristic value in the second image data comprise:

extracting a first gray scale of each pixel unit of the display panel in the first image data, and extracting a second gray scale of each pixel unit of the display panel in the second image data;

comparing whether the first gray scale of each pixel unit of the display panel is consistent with the corresponding second gray scale;

if yes, determining that no data difference exists between the first luminous characteristic value in the first image data and the second luminous characteristic value in the second image data; and if no, determining that a data difference exists between the first luminous characteristic value in the first image data and the second luminous characteristic value in the second image data.

14. The display panel according to claim 13, wherein a successive differential pixel unit is defined to form a differential pixel block;

the difference characteristic value includes the quantity of differential pixel units in the differential pixel block or a difference area corresponding to the differential pixel block;

the operations of determining a difference characteristic value of the differential pixel unit comprise:

determining whether the differential pixel block exists in the differential pixel unit;

determining the quantity of differential pixel units in the differential pixel block on the condition that the difference characteristic value includes the quantity of differential pixel units in the differential pixel block;

and/or determining the quantity of differential pixel units in the differential pixel block on the condition that the difference characteristic value includes a difference area corresponding to the difference pixel block and calculating, according to the quantity of differential pixel units in the differential pixel block and a preset unit area, a difference area corresponding to the differential pixel block;

the operations after determining a difference characteristic value of the differential pixel unit further comprise:

determining whether the quantity of differential pixel units in the differential pixel block is less than or equal to a preset quantity on the condition that the difference characteristic value includes the quantity of differential pixel units in the differential pixel block; and determining whether the difference area is less than or equal to a preset area on the condition that the difference characteristic value includes a difference area corresponding to the difference pixel block;

if yes, determining that the difference characteristic value satisfies the first preset condition; and if no, determining that the difference characteristic value does not satisfy the first preset condition.

* * * * *